US006306808B1

(12) United States Patent
Hazenkamp et al.

(10) Patent No.: US 6,306,808 B1
(45) Date of Patent: Oct. 23, 2001

(54) MANGANESE COMPLEXES AS CATALYSTS FOR PEROXYGENATED COMPOUNDS TO CLEAN HARD SURFACES, ESPECIALLY DISHES

(75) Inventors: Menno Hazenkamp, Basel (CH); Marie-Josée Dubs, Wittersdorf (FR); Frank Bachmann, Freiburg (DE); Gunther Schlingloff, Riehen (CH); Rachel Allemann, Saint-Louis (FR); Josef Dannacher, Basel (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/763,017

(22) PCT Filed: Aug. 6, 1999

(86) PCT No.: PCT/EP99/05699

§ 371 Date: Feb. 15, 2001

§ 102(e) Date: Feb. 15, 2001

(87) PCT Pub. No.: WO00/11129

PCT Pub. Date: Feb. 3, 2000

(30) Foreign Application Priority Data

Aug. 19, 1998 (EP) ..... 98810811

(51) Int. Cl.[7] ..... C11D 7/38; C11D 7/54

(52) U.S. Cl. ..... 510/224; 510/221; 510/372; 510/376; 510/378; 252/186.29; 252/186.33; 134/25.2

(58) Field of Search ..... 510/220, 221, 510/224, 372, 376, 378; 252/186.29, 186.33; 134/25.2

(56) References Cited

U.S. PATENT DOCUMENTS

| | | | | |
|---|---|---|---|---|
| 5,733,341 | * | 3/1998 | Eckhardt et al. | 8/111 |
| 5,741,920 | * | 4/1998 | Eckhardt et al. | 556/45 |
| 5,965,506 | * | 10/1999 | Bacher et al. | 510/311 |
| 6,228,127 | * | 5/2001 | Reinehr et al. | 8/111 |

FOREIGN PATENT DOCUMENTS

| | | | |
|---|---|---|---|
| 630964 | * | 12/1994 | (EP) . |
| 693550 | * | 1/1996 | (EP) . |
| 902083 | * | 3/1999 | (EP) . |
| 2306472 | * | 5/1997 | (GB) . |
| WO 97/07191 | * | 2/1997 | (WO) . |

* cited by examiner

*Primary Examiner*—Gregory Delcotto
(74) *Attorney, Agent, or Firm*—Kevin T. Mansfield

(57) ABSTRACT

The present invention relates to the use of certain manganese complexes as catalysts for reactions with peroxy compounds for bleaching colored stains on hard surfaces. The invention also relates to cleaning agents for hard surfaces comprising such manganese catalysts.

10 Claims, No Drawings

MANGANESE COMPLEXES AS CATALYSTS FOR PEROXYGENATED COMPOUNDS TO CLEAN HARD SURFACES, ESPECIALLY DISHES

The present invention relates to the use of certain manganese complexes as catalysts for reactions with peroxy compounds for bleaching coloured stains on hard surfaces. The invention relates also to cleaning agents for hard surfaces comprising such catalysts.

Inorganic peroxy compounds, especially hydrogen peroxide and solid peroxy compounds that dissolve in water with the release of hydrogen peroxide, such as sodium perborate and sodium carbonate perhydrate, have long been used as oxidising agents for disinfection and bleaching purposes. The oxidising action of such substances in dilute solutions is highly dependent upon temperature. For example, using $H_2O_2$ or perborate in alkaline bleaching liquors it is only at temperatures above about 80° C. that sufficiently rapid bleaching of soiled textiles is achieved. At lower temperatures, the oxidising action of the inorganic peroxy compounds can be improved by the addition of so-called bleach activators, for which numerous proposals have been disclosed in the literature. They are especially compounds from the substance classes of the N- and O-acyl compounds, for example polyacylated alkylenediamines, especially tetraacetylethylenediamine, acylated glycolurils, especially tetraacetylglycoluril, N-acylated hydantoins, hydrazides, triazoles, hydrotriazines, urazoles, diketopiperazines, sulfurylamides and cyanurates, and in addition carboxylic acid anhydrides, especially phthalic anhydride, carboxylic acid esters, especially sodium nonanoyloxybenzenesulfonate, sodium isononanoyloxybenzenesulfonate, and acylated sugar derivatives, such as pentaacetylglucose. By the addition of such substances, the bleaching action of aqueous peroxide liquors can be increased to such an extent that even at temperatures of around 60° C. their action is substantially the same as that of the peroxide liquor alone at 95° C.

Those temperatures are still too high for cleaning hard surfaces, for example table- and kitchen-ware, by hand and are normally not always achieved even in machine dishwashing methods. In the search for energy-saving methods of cleaning table- and kitchen-ware by machine, in recent years temperatures of less than 60° C., especially less than 50° C. down to cold water temperature, have been gaining importance.

At such low temperatures the action of the previously known activator compounds usually declines noticeably, especially in the case of stains that are difficult to bleach, such as tea residues on porcelain or glass. There has therefore been no lack of efforts to develop activators that are more effective in that temperature range, but without there having been any convincing success to date.

A starting point might be provided by the use of transition metal salts and complexes as so-called bleach catalysts. DE-A-195 29 904 and WO 97/07191 already disclose cleaning agents for table- and kitchen-ware that comprise transition metal complexes of the salen type as activators for peroxy compounds, but those compounds too are still unable to meet all requirements.

It has now been found, surprisingly, that manganese complexes of the formulae given below exhibit a markedly improved bleach-catalysing action on coloured stains on hard surfaces. The addition of such complexes in catalytic amounts to a dishwashing agent that comprises a peroxy compound and optionally TAED (N,N,N',N'-tetraacetylethylenediamine) results in the substantial removal of tea stains from porcelain at 45° C. in a dishwasher. This is the case even when hard water is used, it being known that tea deposits are more difficult to remove in hard water than in soft water.

The invention accordingly relates to the use of manganese complexes of formula (1) or (2)

(1)

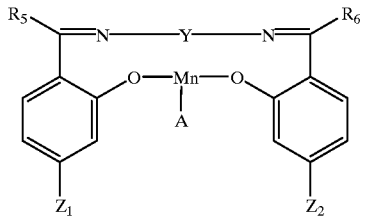

(2)

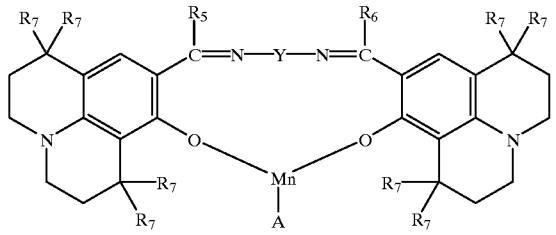

wherein

Y is linear or branched alkylene of formula $—[C(R_1)_2]_m—$, wherein m is an integer from 2 to 8 and each $R_1$ independently of the other(s) is hydrogen or $C_1$–$C_4$alkyl; —CX═CX—, wherein X is cyano, linear or branched $C_1$–$C_8$alkyl or di(linear or branched $C_1$–$C_8$alkyl)amino; $—(CH_2)_q—NR_1—(CH_2)_q—$, wherein $R_1$ is as defined and q is 1, 2, 3 or 4; or a 1,2-cyclohexylene or 1,2-phenylene radical of formula

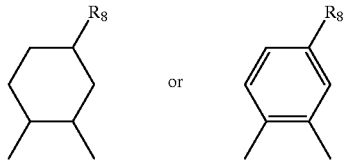

wherein $R_8$ is hydrogen, $CH_2OH$, $CH_2NH_2$ or $SO_3M$, wherein M is hydrogen, an alkali metal atom, ammonium or the cation of an organic amine, $R_5$ and $R_6$ are each independently of the other hydrogen; linear or branched $C_1$–$C_4$alkyl; linear or branched $C_1$–$C_8$alkylene-$R_2$, wherein $R_2$ is $OR_1$, $COOR_1$ or $NR_3R_4$; unsubstituted aryl or aryl substituted by cyano, halogen, $OR_1$, $COOR_1$, nitro, linear or branched $C_1$–$C_8$alkyl, $NR_3R_4$, wherein $R_3$ and $R_4$ are each independently of the other hydrogen or linear or branched $C_1$–$C_{12}$alkyl, or by $—N^{\oplus}R_1R_3R_4$, wherein $R_1$, $R_3$ and $R_4$ are as defined, each $R_7$ independently of the others is hydrogen or $C_1$–$C_4$alkyl, $Z_1$ and $Z_2$ are each independently of the other hydrogen, hydroxy, $C_1$–$C_4$alkoxy or di($C_1$–$C_4$-alkyl)amino, and A is a charge-balancing anionic ligand, as catalysts for reactions with peroxy compounds in cleaning solutions for hard surfaces, especially for table- and kitchen-ware, with the proviso that, in the compounds of formula (1), when Y is 1,2-phenylene the substituents $Z_1$, $Z_2$, $R_5$ and $R_6$ may not all simultaneously be hydrogen.

The preferred compounds according to formula (1) include those wherein $Z_1$ and/or $Z_2$ each independently of the other is/are hydrogen, hydroxy, methoxy, ethoxy, dimethylamino or diethylamino.

The preferred compounds according to formulae (1) and (2) also include those wherein Y is ethylene, 1,2- or 1,3-propylene, 1-methyl-1,2-propylene, 2-methyl-1,2-propylene, 1,2-cyclohexylene or 1,2-phenylene. Especially preferred meanings of Y are ethylene, 1,3-propylene, 2-methyl-1,2-propylene, 1,2-cyclohexylene and 1,2-phenylene.

When Y is a 1,2-cyclohexylene radical, it may be in either of its stereoisomeric cis/trans forms.

$R_5$ and $R_6$ are each independently of the other preferably hydrogen, methyl, ethyl or unsubstituted phenyl, especially hydrogen.

Alkyl radicals containing from 1 to 4 carbon atoms include especially the methyl, ethyl, n-propyl, isopropyl, n-butyl, sec-butyl, isobutyl and tert-butyl group.

$R_1$ is preferably methyl or especially hydrogen.

$R_7$ is preferably hydrogen, methyl or ethyl, especially methyl.

$R_8$ is preferably hydrogen.

The charge-balancing anionic ligand A in the compounds of formulae (1) and (2) can be mono- or poly-valent, it being possible in the latter case for a correspondingly greater number of manganese atoms to be neutralised with the said organic ligands. It is preferably a halide, especially a chloride, a hydroxide, hexafluorophosphate, perchlorate or the anion of a carboxylic acid, such as formate, acetate, benzoate or citrate.

The compounds according to formulae (1) and (2) used according to the invention are known or can be prepared by procedures known in principle by the reaction of salicylaldehyde, which may carry the above-defined substituents $Z_1$ or $Z_2$ or has two fused rings as in the case of the compounds of formula (2), with diamines $H_2N—Y—NH_2$ and reaction of the salen ligands so obtainable with manganese salts, as described, for example, in European Patent Application EP-A-630 964.

The compounds of formula (1) or (2) can be used on their own or in admixtures of two or more compounds of formula (1) or (2). In addition, they can also be used together with one or more uncomplexed salen ligands, for example with those ligands present in the compounds of formula (1) or (2).

The invention relates also to cleaning agents for hard surfaces, especially cleaning agents for table- and kitchen-ware and, among such agents, preferably those for use in cleaning processes carried out by machine, which agents comprise one of the above-described compounds of formula (1) or (2) as bleach catalyst, and to a method of cleaning hard surfaces, especially table- and kitchen-ware, using such a bleach catalyst.

The use according to the invention lies essentially in providing, in the presence of a hard surface soiled with coloured stains, conditions under which a peroxide-containing oxidising agent and the bleach catalyst according to formula (1) or (2) are able to react with one another with the aim of obtaining resulting products having a more strongly oxidising action. Such conditions are present especially when the two reactants encounter one another in aqueous solution. This can be brought about by separately adding the peroxy compound and the bleach catalyst to a solution which may optionally contain cleaning agent. The method according to the invention is, however, advantageously carried out using a cleaning agent for hard surfaces according to the invention that comprises the bleach catalyst and a peroxy-containing oxidising agent. The peroxy compound can also be added to the solution separately, as such or in the form of a preferably aqueous solution or suspension, when a peroxide-free cleaning agent is used.

Depending upon the intended use, the conditions can be widely varied. For example, in addition to purely aqueous solutions, mixtures of water and suitable organic solvents also come into consideration as reaction medium. The amounts of peroxy compounds used are generally so selected that from 10 ppm to 10% active oxygen, preferably from 50 ppm to 5000 ppm active oxygen, are present in the solutions. The amount of bleach catalyst used also depends upon the intended use. Depending upon the desired degree of activation, from 0.00001 mol to 0.025 mol, preferably from 0.0001 mol to 0.02 mol, of activator is used per mole of peroxy compound, but in special cases amounts above or below those limits may also be used.

The invention relates also to a cleaning agent for hard surfaces, especially for table- and kitchen-ware, that comprises from 0.001% by weight to 1% by weight, especially from 0.005% by weight to 0.1% by weight, bleach catalyst according to formula (1) or (2) in addition to customary ingredients compatible with the bleach catalyst. The bleach catalyst may, in a manner known in principle, be adsorbed on carriers and/or embedded in encapsulating substances.

The cleaning agents according to the invention, which can be in the form of powder- or tablet-form solids, or homogeneous solutions or suspensions, may in principle comprise, in addition to the bleach catalyst used according to the invention, any known ingredients customary in such agents. The agents according to the invention may comprise especially builder substances, surface-active surfactants, peroxy compounds, water-miscible organic solvents, enzymes, sequestering agents, electrolytes, pH regulators and further adjuvants, such as silver-corrosion inhibitors, foam regulators, additional peroxy activators and also colourings and perfumes.

A cleaning agent for hard surfaces according to the invention can also comprise abrasive constituents, especially from the group comprising quartz powders, wood flours, ground plastics, chalks and glass microbeads, and mixtures thereof. Abrasive substances are present in the cleaning agents according to the invention preferably in amounts not exceeding 20% by weight, especially in amounts of from 5% by weight to 15% by weight.

The invention relates also to an agent of low alkalinity for cleaning table- and kitchen-ware by machine, a 1% by weight solution of which has a pH value of from 8 to 11.5, preferably from 9 to 10.5, containing from 15% by weight to 60% by weight, especially from 30% by weight to 50% by weight, water-soluble builder component, from 3% by weight to 25% by weight, especially from 5% by weight to 15% by weight, oxygen-based bleaching agent, in each case based on the total agent, which agent comprises a bleach catalyst according to formula (1) or (2), especially in amounts of from 0.005% by weight to 0.1% by weight.

Water-soluble builder components that come into consideration in such low-alkalinity cleaning agents include, in principle, any builders customarily used in machine dishwashing agents, for example polymeric alkali metal phosphates, which may be in the form of their alkaline, neutral or acidic sodium or potassium salts. Examples thereof are tetrasodium diphosphate, disodium dihydrogen diphosphate, pentasodium triphosphate, sodium tripolyphosphate, so-called sodium hexametaphosphate and the corresponding potassium salts as well as mixtures of sodium and potassium salts. They may be present in amounts in the range of up to about 35% by weight, based on the total agent. Further possible water-soluble builder components are, for example, organic polymers of natural or synthetic origin, especially polycarboxylates, which, particularly in hard water areas, act as co-builders.

There come into consideration, for example, polyacrylic acids and copolymers of maleic anhydride and acrylic acid and also the sodium salts of those polymeric acids. Commercially available products are, for example, Sokalan® CP 5 and PA 30 from BASF. Polymers of natural origin that can be used as co-builders include, for example, oxidised starch, as known, for example, from International Patent Application WO 94/05762, and polyamino acids, such as polyglutamic acid or polyaspartic acid. Further possible builder components are naturally occurring hydroxycarboxylic acids, e.g. mono- and di-hydroxysuccinic acid, α-hydroxypropionic acid and gluconic acid. There also come into consideration as builder components the salts of citric acid, especially sodium citrate. As sodium citrate there come into consideration anhydrous trisodium citrate and especially trisodium citrate dihydrate. Trisodium citrate dihydrate can be used in the form of a fine- or coarse-crystalline powder. Depending upon the pH value ultimately established in the agents according to the invention, the acids corresponding to the mentioned co-builder salts may also be present.

Oxygen-based bleaching agents that come into consideration include especially alkali metal perborate mono- and tetra-hydrate and/or alkali metal percarbonate, sodium being the preferred alkali metal. The use of sodium percarbonate has advantages especially in cleaning agents for table- and kitchen-ware, since it has a particularly advantageous effect on corrosion behaviour in glasses. In addition, or especially alternatively, it is also possible for known peroxycarboxylic acids to be present, for example dodecane-diperacid or phthalamidopercarboxylic acids, which may be unsubstituted or substituted on the aromatic moiety. Furthermore, the addition of small amounts of known bleaching agent stabilisers, for example phosphonates, borates or metaborates and metasilicates, and also magnesium salts, such as magnesium sulfate, may be advantageous.

In addition to the bleach catalysts according to formula (1) or (2) it is also possible to use further known transition metal salts or complexes known as bleach-activating active ingredients and/or conventional bleach activators, that is to say compounds that, under perhydrolysis conditions, yield unsubstituted or substituted perbenzo- and/or peroxocarboxylic acids having from 1 to 10 carbon atoms, especially from 2 to 4 carbon atoms. Suitable bleach activators include the customary bleach activators, mentioned at the beginning, that carry O- and/or N-acyl groups having the indicated number of carbon atoms and/or unsubstituted or substituted benzoyl groups. Preference is given to polyacylated alkylenediamines, especially tetraacetylethylenediamine (TAED), acylated glycolurils, especially tetraacetylglycoluril (TAGU), N,N-diacetyl-N,N-dimethylurea (DDU), acylated triazine derivatives, especially 1,5-diacetyl-2,4-dioxohexahydro-1,3,5-triazine (DADHT), acylated phenylsulfonates, especially nonanoyloxy- or isononanoyloxy-benzenesulfonate, acylated polyvalent alcohols, especially triacetin, ethylene glycol diacetate and 2,5-di-acetoxy-2,5-dihydrofuran, and also acetylated sorbitol and mannitol and acylated sugar derivatives, especially pentaacetylglucose (PAG), sucrose polyacetate (SUPA), penta-acetylfructose, tetraacetylxylose and octaacetyllactose as well as acetylated, optionally N-alkylated glucamine and gluconolactone. It is also possible to use the combinations of conventional bleach activators known from German Patent Application DE-A-44 43 177.

The low-alkalinity machine dishwashing agents according to the invention preferably comprise the customary alkaline carriers, for example alkali silicates, alkali carbonates and/or alkali hydrogen carbonates. The alkaline carriers customarily used include carbonates, hydrogen carbonates and alkali silicates having a molar ratio $SiO_2/M_2O$ (M=alkali metal atom) of from 1.5:1 to 2.5:1. Alkali silicates can be present in amounts of up to 30% by weight, based on the total agent. It is preferable to dispense altogether with the use of the highly alkaline metasilicates as alkaline carriers. The alkaline carrier system preferably used in the agents according to the invention is a mixture of carbonate and hydrogen carbonate, preferably sodium carbonate and hydrogen carbonate, which mixture is present in an amount of up to 60% by weight, preferably from 10% by weight to 40% by weight. Depending upon the pH value ultimately desired, the ratio of carbonate used to hydrogen carbonate used will vary, but usually an excess of sodium hydrogen carbonate is used, so that the ratio by weight of hydrogen carbonate to carbonate is generally from 1:1 to 15:1.

In a further preferred embodiment, the agents according to the invention contain from 20% by weight to 40% by weight water-soluble organic builder, especially alkali citrate, from 5% by weight to 15% by weight alkali carbonate and from 20% by weight to 40% by weight alkali silicate.

If desired, it is also possible to add surfactants to the agents according to the invention, especially weakly foaming non-ionic surfactants, that serve for the better removal of fat-containing stains, as wetting agents and optionally within the framework of the preparation of the cleaning agents as granulation auxiliaries. They may be present in an amount of up to 10% by weight, especially up to 5% by weight, and preferably in the range of from 0.5% by weight to 3% by weight. Especially for use in machine dishwashing procedures it is customary to use extremely low-foam compounds. These include especially $C_{12}$–$C_{18}$alkylpolyethylene glycol-polypropylene glycol ethers each having up to 8 mol of ethylene oxide and propylene oxide units in the molecule. It is also possible, however, to use other known low-foam non-ionic surfactants, for example $C_{12}$–$C_{18}$alkylpolyethylene glycol-polybutylene glycol ethers each having up to 8 mol of ethylene oxide and butylene oxide units in the molecule, end-group-terminated alkylpolyalkylene glycol mixed ethers, and also the foaming but ecologically attractive $C_8$–$C_{14}$alkylpolyglucosides having a degree of polymerisation of approximately from 1 to 4 and/or $C_{12}$–$C_{14}$alkylpolyethylene glycols having from 3 to 8 ethylene oxide units in the molecule. Also suitable are surfactants from the glucamide family, e.g. alkyl-N-methylglucamides in which the alkyl moiety preferably consists of a fatty alcohol having a carbon chain length of $C_6$–$C_{14}$. In some cases it is advantageous for the described surfactants to be used in the form of mixtures, for example a combination of alkylpolyglycoside with fatty alcohol ethoxylates or of glucamide with alkylpolyglycosides.

Although manganese complexes are known to counteract the corrosion of silver, the compounds of formula (1) or (2) are generally used in amounts that are too small to protect silver against corrosion, so that the cleaning agents according to the invention for table- and kitchen-ware can additionally comprise silver-corrosion inhibitors, the action of which can be reinforced by the compounds according to formula (1) or (2). Preferred silver-corrosion protective agents are organic disulfides, divalent phenols, trivalent phenols, unsubstituted or substituted benzotriazole, and manganese, titanium, zirconium, hafnium, vanadium, cobalt or cerium salts and/or complexes, in which the said metals are present in one of oxidation states II, III, IV, V and VI.

In addition, the agents according to the invention may comprise enzymes, such as proteases, amylases, pullulanases, cutinases and lipases, for example proteases such as BLAP®, Optimase®, Opticlean®, Maxacal®, Maxapem®, Esperase® and/or Savinase®, amylases such as Termamyl®, Amylase-LT®, Maxamyl® and/or Duramyl®, lipases such as Lipolase®, Lipomax®, Lumafast® and/or Lipozym®. The enzymes which may be used can, as described e.g. in International Patent Applications WO 92/11347 and WO 94/23005, be adsorbed on carriers and/or embedded in encapsulating substances in order to safeguard them against premature inactivation. They are present in the cleaning agents according to the invention preferably in amounts not exceeding 2% by weight, especially in amounts of from 0.1% by weight to 1.2% by weight.

If the cleaning agents produce too much foam in use, there may be added thereto up to 6% by weight, preferably about from 0.5% by weight to 4% by weight, of a foam-suppressing compound, preferably from the group of silicone oils, mixtures of silicone oil and hydrophobic silicic acid, paraffin, paraffin/alcohol combinations, hydrophobic silicic acid, bisfatty acid amides and other known commercially available defoamers. Further optional ingredients in the agents according to the invention include, for example, perfume oils.

Organic solvents that can be used in the cleaning agents according to the invention, especially when the latter are in liquid or paste form, include alcohols having from 1 to 4 carbon atoms, especially methanol, ethanol, isopropanol and tert-butanol, diols having from 2 to 4 carbon atoms, especially ethylene glycol and propylene glycol, and mixtures thereof, and the ethers derivable from the mentioned classes of compound. Such water-miscible solvents are present in the cleaning agents according to the invention preferably in amounts not exceeding 20% by weight, especially in amounts of from 1% by weight to 15% by weight.

In order to establish a desired pH value where that pH value does not arise of itself when the other components are mixed together, the agents according to the invention may comprise system-compatible and environmentally friendly acids, especially citric acid, acetic acid, tartaric acid, malic acid, lactic acid, glycolic acid, succinic acid, glutaric acid and/or adipic acid, and also mineral acids, especially sulfuric acid, or alkali hydrogen sulfates, or bases, especially ammonium or alkali hydroxides. Such pH regulators are present in the agents according to the invention preferably in amounts not exceeding 10% by weight, especially in amounts of from 0.5% by weight to 6% by weight.

The preparation of the solid agents according to the invention is problem-free and can be carried out in a manner known in principle, for example by spray-drying or granulation, peroxy compound and bleach catalyst optionally being added separately at a later stage.

Cleaning agents according to the invention in the form of aqueous solutions or solutions containing some other customary solvent are produced especially advantageously by simply mixing together the ingredients, which can be introduced into an automatic mixer as such or in the form of a solution.

The agents according to the invention are preferably in the form of powder-form, granular or tablet-form preparations which can be produced in a manner known per se, for example by mixing, granulating, roller-compacting and/or by spray-drying those components which are able to withstand thermal stress and then mixing in the more sensitive components, which include especially enzymes, bleaching agents and the bleach catalyst.

For the preparation of the cleaning agents according to the invention in tablet-form, the procedure is preferably as follows: all the constituents are mixed together in a mixer and the mixture is compressed by means of conventional tabletting presses, for example eccentric tablet presses or rotary tablet presses, at compression pressures in the range of from $200 \cdot 10^5$ Pa to $1500 \cdot 10^5$ Pa. There are thus obtained in a problem-free manner tablets that are resistant to breaking but nevertheless dissolve sufficiently rapidly under use conditions and have a flexural strength usually exceeding 150 N. A tablet so produced preferably has a weight of from 15 g to 40 g, especially from 20 g to 30 g, at a diameter of from 35 mm to 40 mm.

The preparation of the agents according to the invention in the form of non-dusty, storage-stable pourable powders and/or granules having high bulk densities in the range of from 800 to 1000 g/l can be carried out by, in a first process step, mixing the builder components with at least some of the liquid mixing components, thus increasing the bulk density of the resulting premix, and subsequently—if desired after intermediate drying—combining the other constituents of the agent, including the bleach catalyst, with the premix so obtained.

Agents according to the invention for the cleaning of table- and kitchen-ware can be used both in household dishwashers and in industrial washers. They are added by hand or using suitable metering devices. The concentrations used in the cleaning liquor are generally about from 1 to 8 g/l, preferably from 2 to 5 g/l.

A machine washing programme is generally supplemented and completed by a number of intermediate rinsing cycles with clear water after the cleaning cycle and by a clear-rinsing operation with a customary rinse agent. The use of the agents according to the invention results, after drying, in completely clean table- and kitchen-ware that is impeccable from the hygienic standpoint.

EXAMPLES

The following substances are tested:

(1)

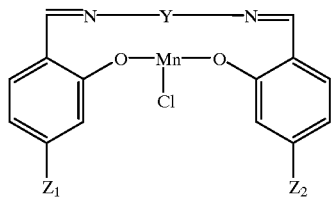

| Substance | Y | $Z_1$ | $Z_2$ |
|---|---|---|---|
| (101) | 1,2-cyclohexylene | $—N(C_2H_5)_2$ | $—N(C_2H_5)_2$ |
| (102) | 1,2-ethylene | $—N(C_2H_5)_2$ | $—N(C_2H_5)_2$ |
| (103) | 1,2-ethylene | —OH | —OH |
| (104) | 1,2-ethylene | $—N(CH_3)_2$ | $—N(CH_3)_2$ |
| (105) | 1,2-ethylene | —H | —H |
| (106) | 1,2-ethylene | $—OCH_3$ | $—OCH_3$ |
| (107) | 1,3-propylene | $—N(C_2H_5)_2$ | $—N(C_2H_5)_2$ |
| (108) | 2-methyl-1,2-propylene | $—N(C_2H_5)_2$ | $—OCH_3$ |

-continued (1)

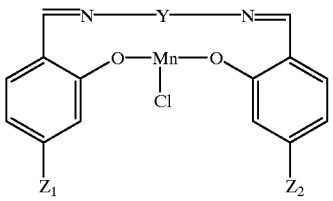

| Substance | Y | $Z_1$ | $Z_2$ |
|---|---|---|---|
| (109) | 2-methyl-1,2-propylene | $—N(C_2H_5)_2$ | —H |
| (110) | 1,2-phenylene | OH | OH |

The compounds (108) and (109) have the following structures:

(108)

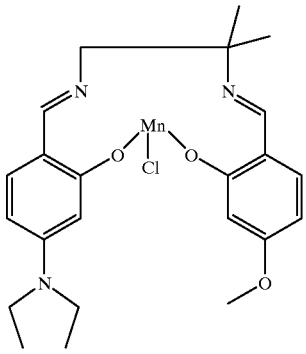

(109)

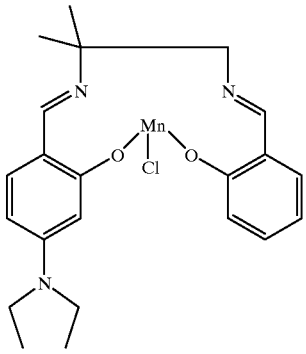

The following substances are also tested:

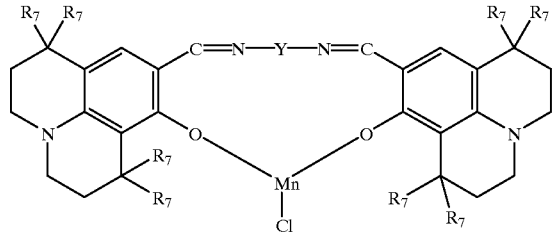

| Substance | Y | $R_7$ |
|---|---|---|
| (111) | 1,2-cyclohexylene | $CH_3$ |
| (112) | 1,2-ethylene | $CH_3$ |

Example 1

Staining Procedure

A tea brew (12 g of tea leaves/liter) is prepared from black tea (Twinings brand) and hard water (total hardness: 18° dH) by stirring at 99° C. The tea brew is left to draw for five minutes and the tea is filtered. Approximately 100 ml of tea are then poured into a procelain cup. The tea is left to stand in the cups for 30 minutes. The cups are then emptied in three steps each of approximately 35 ml. A period of five minutes is left between the emptying steps. The completely empty cups are dried for 60 minutes at 70° C.

Cleaning Procedure

The cups are cleaned in a Miele G-690 D dishwasher on the delicate programme at 45° C. using hard water. In each cleaning programme 12 tea-stained cups are cleaned. The machine also contains six glasses with milk stains, 24 clean plates and 60 g of a mixture of different foodstuffs (inter alia spinach, egg, minced meat, starch). The dose of dishwashing agent is: 17.2 g of a phosphate-containing base formulation, 1.72 g of sodium perborate monohydrate, 0.8 g of TAED and, as appropriate, 50 ppm of catalyst (ppm based on the metal). After the cleaning operation, the removal of the tea deposit is evaluated visually on a scale from 0 (=unchanged, very strong deposit) to 10 (=no deposit). Table 1 shows the ratings for our catalysts compared with a reference (TAED only, no catalyst). The ratings indicated in the Table are the median values from several cleaning programmes each using 12 cups. The Table shows that the ratings for the catalysts used according to the invention are significantly better than the reference value.

TABLE 1

Ratings for removal of the deposit

| Complex | Rating |
|---|---|
| Reference (TAED only, no cat.) | 1 |
| (101) | 6.25 |
| (102) | 4.75 |
| (103) | 5.25 |
| (104) | 8 |
| (105) | 10 |
| (106) | 4 |
| (107) | 6.5 |
| (108) | 9.5 |
| (109) | 10 |
| (110) | 2.5 |
| (111) | 5.75 |
| (112) | 2.5 |

Similar results are obtained when a dishwashing agent of the following composition is used together with 50 ppm of the catalysts used in the above Table, 1.72 g of sodium perborate monohydrate and 0.8 g of TAED.

| Ingredient | % by weight |
|---|---|
| sodium tripolyphosphate | 30 |
| sodium carbonate | 25 |
| hydrated 2.0 r silicate | 18.5 |
| non-ionic surfactant | 2.5 |
| polymer (60% acrylic acid, 20% maleic acid, 20% ethyl acrylate) | 5 |
| protease (4% active) | 1 |
| amylase (0.8% active) | 0.5 |
| water, sodium sulfate, etc. | remainder to 100% |

Example 2

10.1 mg (30 $\mu$mol) of morin dihydrate are dissolved in 1000 ml of a borax buffer solution (9 mmol of disodium tetraborate/liter, pH=9.4). At t=0 min., 295 mg (2.5 mmol) of sodium perborate monohydrate and, as appropriate, 3.4 $\mu$mol of catalyst or 137 mg (0.6 mmol) of TAED are added. Over a period of 30 minutes, the extinction E of the solution at 400 nm is measured at 27° C. at one minute intervals. The values for the percentage decoloration D(t), calculated in accordance with D(t)=[E(0)−E(t)]/E(0)*100, are indicated in Table 2.

It will be seen that the bleaching action in solution in the case of compounds (101) to (104) is better than that of TAED, although the concentration of TAED is much higher. It will also be seen that after 30 minutes better decoloration is obtained than with compound M2.

TABLE 2

| Percentage decoloration as a function of time | | | |
|---|---|---|---|
| Substance | 5 minutes | 15 minutes | 30 minutes |
| TAED | 8 | 33 | 56 |
| (102) | 40 | 78 | 83 |
| (101) | 3 | 23 | 59 |
| (103) | 52 | 80 | 83 |
| (104) | 78 | 83 | 84 |

Example 3

A good cleaning action is likewise obtained by proceeding as described in Example 1 but using as catalyst an equivalent amount of the compound of formula (115)

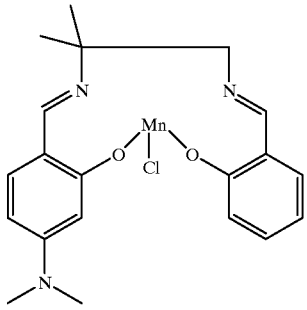

Example 4

The procedure of Example 1 of EP-A-630 964 is carried out, but instead of salicylaldehyde there is used an equivalent amount of a 1:1 mixture of salicylaldehyde and 2-hydroxy-4-diethylamino-benzaldehyde and instead of ethylenediamine an equivalent amount of 2-amino-2-methyl-3-aminopropane. The manganese complex is then formed as described therein. A mixture of the following four manganese complexes is obtained:

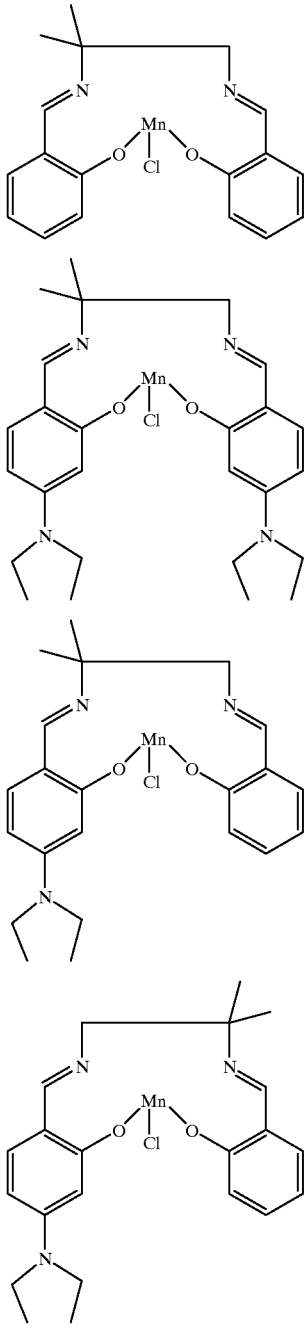

A good cleaning action is likewise obtained by proceeding as described in Example 1 but using as catalyst an equivalent amount of the above mixture.

Example 5

A good cleaning action is also obtained when instead of the mixture from Example 4 there is used a mixture containing only the latter two complexes indicated. That mixture can be obtained by purifying the mixture of the uncomplexed ligands from the first step of the preparation in accordance with Example 4.

What is claimed is:

1. A method of cleaning a hard surface, which comprises contacting the surface with a solution containing a peroxy compound and, as catalyst for the peroxy compound, a manganese complex of the formula (1) or (2)

(1)

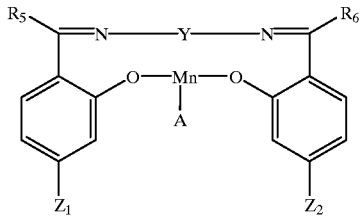

(2)

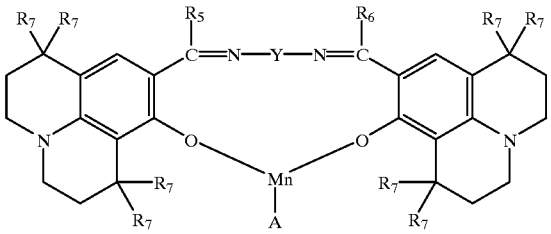

wherein

Y is linear or branched alkylene of formula —$[C(R_1)_2]_m$—, wherein m is an integer from 2 to 8 and each $R_1$ is independently hydrogen or $C_1$–$C_4$alkyl; —CX═CX—, wherein X is cyano, linear or branched $C_1$–$C_8$alkyl or di(linear or branched $C_1$–$C_8$alkyl)amino; —$(CH_2)_q$—$NR_1$—$(CH_2)_q$—, wherein $R_1$ is as defined and q is 1, 2, 3 or 4; or a 1,2-cyclohexylene or 1,2-phenylene radical of formula

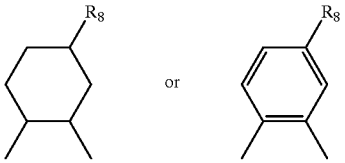

wherein $R_8$ is hydrogen, $CH_2OH$, $CH_2NH_2$ or $SO_3M$, wherein M is hydrogen; an alkali metal atom, ammonium or the cation of an organic amine, $R_5$ and $R_6$ are each independently of the other hydrogen; linear or branched $C_1$–$C_4$alkyl; linear or branched $C_1$–$C_8$alkylene-$R_2$, wherein $R_2$ is $OR_1$, $COOR_1$ or $NR_3R_4$; unsubstituted aryl or aryl substituted by cyano, halogen, $OR_1$, $COOR_1$, nitro, linear or branched $C_1$–$C_8$alkyl, $NR_3R_4$, wherein $R_3$ and $R_4$ are each independently of the other hydrogen or linear or branched $C_1$–$C_{12}$alkyl, or by —$N^{\oplus}R_1R_3R_4$, wherein $R_1$, $R_3$ and $R_4$ are as previously defined, each $R_7$ independently of the others is hydrogen or $C_1$–$C_4$alkyl, $Z_1$ and $Z_2$ are each independently of the other hydrogen, hydroxy, $C_1$–$C_4$alkoxy or di($C_1$–$C_4$alkyl)amino, and A is a charge-balancing anionic ligand, with the proviso that, in the compounds of the formula (1), when Y is 1,2-phenylene the substituents $Z_1$, $Z_2$, $R_5$ and $R_6$ may not all simultaneously be hydrogen.

2. A method of cleaning a hard surface, wherein the hard surface comprises table- or kitchen-ware.

3. A method according to claim 1 wherein, in formula (1), $Z_1$ and $Z_2$ are each independently of the other hydrogen, hydroxy, methoxy, ethoxy, dimethylamino or diethylamino.

4. A method according to claim 1 wherein, in formula (1) and (2), Y is ethylene, 1,2- or 1,3-propylene, 1-methyl-1,2-propylene, 2-methyl-1,2-propylene, 1,2-cyclohexylene or 1,2-phenylene.

5. A method according to claim 4, wherein Y is ethylene, 1,3-propylene, 2-methyl-1,2-propylene, 1,2-cyclohexylene or 1,2-phenylene.

6. A method according to claim 1 wherein, in formula (1) and (2), $R_5$ and $R_6$ are each independently of the other hydrogen, methyl, ethyl or unsubstituted phenyl.

7. A method according to claim 1 wherein, in formula (2), each $R_7$ independently of the others is hydrogen, methyl or ethyl.

8. A method according to claim 1, wherein the charge-balancing anionic ligand A in the compound of formula (1) or (2) is halide, hydroxide, hexafluorophosphate, perchlorate or the anion of an organic carboxylic acid.

9. A method according to claim 1, wherein the peroxy compound is selected from the group consisting of organic peracids, hydrogen peroxide, perborate and percarbonate, and mixtures thereof.

10. A method according to claim 1, wherein there is additionally used a bleach activator.

* * * * *

UNITED STATES PATENT AND TRADEMARK OFFICE

CERTIFICATE OF CORRECTION

PATENT NO. : 6,306,808 B1
DATED : October 23, 2001
INVENTOR(S) : Menno Hazenkamp et al.

It is certified that error appears in the above-identified patent and that said Letters Patent is hereby corrected as shown below:

Title page,
Section (87) the PCT publication date should read -- Mar. 2, 2000 --.

Signed and Sealed this

Twenty-eighth Day of May, 2002

*Attest:*

*Attesting Officer*

JAMES E. ROGAN
*Director of the United States Patent and Trademark Office*